US011447956B1

(12) United States Patent
Battel et al.

(10) Patent No.: US 11,447,956 B1
(45) Date of Patent: Sep. 20, 2022

(54) GLASS PANEL RAILING SECUREMENT

(71) Applicant: UFP Industries, Inc., Grand Rapids, MI (US)

(72) Inventors: David Battel, Edina, MN (US); Terrance M. Potting, White Bear Lake, MN (US)

(73) Assignee: UFP Industries, Inc., Grand Rapids, MI (US)

( * ) Notice: Subject to any disclaimer, the term of this patent is extended or adjusted under 35 U.S.C. 154(b) by 297 days.

(21) Appl. No.: 16/788,282

(22) Filed: Feb. 11, 2020

Related U.S. Application Data

(60) Provisional application No. 62/804,203, filed on Feb. 11, 2019.

(51) Int. Cl.
*E04F 11/18* (2006.01)

(52) U.S. Cl.
CPC ..... *E04F 11/1853* (2013.01); *E04F 11/1817* (2013.01); *E04F 2011/1829* (2013.01); *E04F 2011/1895* (2013.01)

(58) Field of Classification Search
CPC ..... E04F 11/1817; E04F 11/1853; E04F 2011/1895; E04F 2011/1829; E04F 11/181; E04F 11/1851; E04F 2011/1823; E04F 2011/1825; F16B 5/121; F16B 5/128; F16B 5/123; E06B 3/54; E06B 3/5409; E06B 3/5481; E04H 17/16; E04H 17/1602; E04H 17/165; E04H 17/17
See application file for complete search history.

(56) References Cited

U.S. PATENT DOCUMENTS 2,873,094 A * 2/1959 Blum ..... E04F 11/181 256/31
3,385,567 A 5/1968 Case et al.
3,454,262 A 7/1969 Romano
3,482,819 A 12/1969 Leurent
3,506,243 A 4/1970 Seiler
3,924,834 A * 12/1975 Young ..... E04F 11/181 256/22
4,346,872 A 8/1982 Tornya
(Continued)

FOREIGN PATENT DOCUMENTS

CN 201679173 U 12/2010
DE 4112923 A1 * 10/1991 ..... E04F 11/1853
(Continued)

*Primary Examiner* — Josh Skroupa
(74) *Attorney, Agent, or Firm* — McGarry Bair PC

(57) ABSTRACT

A selectively inserted panel securement secures a panel into a balustrade, and a fastener affixes the panel securement into a top rail of the balustrade. The panel securement comprises a base inserted into a recess within the bottom of the top rail, a riser affixed on one end to the base and having a contact surface adjacent to a panel side edge that restricts panel movement in a first axial direction; and a panel retaining member extending perpendicularly from the riser on a second end distal to the base. The panel retaining member is inserted into a top railing channel and restricts panel movement in a second axial direction. A notch in the base secures the panel in a third axial direction, thereby preventing movement of the panel in three orthogonal axes. The fastener fastens the selectively inserted panel securement to the top rail within the channel.

20 Claims, 3 Drawing Sheets

(56) References Cited

U.S. PATENT DOCUMENTS

| | | | | |
|---|---|---|---|---|
| 4,690,383 | A | 9/1987 | Batcheller | |
| 4,753,420 | A | 6/1988 | Kaaria | |
| 4,805,879 | A | 2/1989 | Spera | |
| 4,912,898 | A | 4/1990 | Holmes | |
| 4,968,005 | A | 11/1990 | Zen | |
| D446,315 | S | 8/2001 | Forbis | |
| 6,912,818 | B2 * | 7/2005 | Sprague | E06B 3/02 52/204.56 |
| 7,497,057 | B1 | 3/2009 | Hansen et al. | |
| 7,530,549 | B1 | 5/2009 | Hansen et al. | |
| 7,617,650 | B1 | 11/2009 | Hansen et al. | |
| 9,074,413 | B1 * | 7/2015 | Sprague | E06B 3/5878 |
| 9,777,484 | B2 * | 10/2017 | Header | E04F 11/1853 |
| 2005/0017232 | A1 * | 1/2005 | Chen | E04F 11/1851 256/59 |
| 2006/0070318 | A1 * | 4/2006 | Chen | E06B 3/5454 52/204.65 |
| 2020/0109568 | A1 * | 4/2020 | Downs | E04F 11/1812 |
| 2021/0254346 | A1 * | 8/2021 | Sprague | E04F 11/1853 |

FOREIGN PATENT DOCUMENTS

| | | | | |
|---|---|---|---|---|
| DE | 29515491 | U1 * | 1/1996 | E04F 11/1851 |
| FR | 2450336 | A1 * | 9/1980 | E06B 3/5409 |
| GB | 1133417 | A * | 11/1968 | E04F 11/1851 |
| JP | 2011190631 | A | 9/2011 | |

* cited by examiner

GLASS PANEL RAILING SECUREMENT

CROSS REFERENCE TO RELATED APPLICATIONS

The present application claims the benefit of U.S. provisional patent application 62/804,203 filed Feb. 11, 2019 of like inventorship, the teachings and entire contents which are incorporated herein by reference.

BACKGROUND OF THE INVENTION

1. Field of the Invention

The present invention pertains generally to balustrades, and more particularly to securing panels between the rails and balusters within a balustrade. In a particular manifestation of the invention, a pair of panel securements are fastened within an underside channel and lip of an extruded railing, and secure a glass panel in three orthogonal axes.

2. Description of the Related Art

Balustrades, also commonly referred to as railings, are a type of enclosure that includes a rail that joins together a plurality of balusters to form a part of an enclosure for balconies, staircases, terraces, and the like. The balusters comprise posts of various geometry that often rise vertically up to and provide support for the upper rail, though in some instances the balusters may actually rise above the upper rail. Exemplary U.S. patents, the teachings which are incorporated herein by reference, include: U.S. Pat. No. 3,482,819 by Leurent, entitled "Metal railings and similar elements"; U.S. Pat. No. 4,805,879 by Spera, entitled "Hand railing assembly"; U.S. Pat. No. 4,968,005 by Zen, entitled "Picket attachment"; and Des U.S. Pat. No. 446,315 by Forbis, entitled "Fence rail".

In some cases the balusters may provide the primary enclosure, meaning there is open space between each baluster. However, in such cases and where there is any chance of small children being present, the balusters must be very close together to prevent the child from slipping through between the balusters and accidentally falling. As may be appreciated, not only does this make the cost of the balusters greater, due to the increased number required and the increased installation expense, but the balusters in such arrangement will also substantially decrease visibility through the balustrade. Sometimes to reduce the cost of fabrication and installation, while also greatly increasing safety in the presence of small children, and for other reasons such as providing unique appearance or improved visibility, a number of artisans have proposed inserting panels between the balusters. These panels may comprise lattice work, which similar to the balusters will only partially reduce visibility and will add decorative affect. Other types of panels may be inserted as well, giving an architect or decorator much opportunity to customize the appearance of the balustrade. Exemplary U.S. patents, the teachings which are incorporated herein by reference, include: U.S. Pat. No. 3,454,262 by Romano, entitled "Interchangeable fence construction"; U.S. Pat. No. 3,506,243 by Seiler, entitled "Prefabricated railing"; U.S. Pat. No. 3,924,834 by Young, entitled "Balustrade units"; and U.S. Pat. Nos. 7,497,057 and 7,617,650 by Hansen et al, entitled "Fascia-mounted aluminum railing system".

In many instances, visibility through the balustrade is highly desired. In such instances, a glass panel may be inserted as disclosed in the aforementioned patents incorporated immediately herein above by reference. Typically, these glass panels are relatively thick. Also in many cases the glass panels are also tempered or otherwise treated or fabricated to ensure adequate strength and safety.

One type of railing comprises an aluminum extrusion that can be delivered to a job site in long, standard lengths. The aluminum is easily cut on location to the particular length required for the particular balcony or other application. Where a panel will be installed, there will often be provided both a top railing and a bottom railing, each with a longitudinally extensive slot or channel into which the panel will be inserted. One particularly preferred combination in the case of a glass panel is the provision of an extruded plastic insert that fits within and engages the aluminum extrusion. Exemplary U. S. patents, the teachings which are incorporated herein by reference, include: U.S. Pat. No. 4,346,872 by Tornya, entitled "Balustrade construction"; U.S. Pat. No. 4,690,383 by Batcheller, entitled "Panel rail system"; U.S. Pat. No. 4,753,420 by Kaaria, entitled "Railing system"; and U.S. Pat. No. 7,530,549 by Hansen et al, entitled "Articulating balcony railing system". The plastic insert offers resilience and cushioning, allowing the plastic to fit securely around the top and bottom edges of the glass. By ensuring a secure and resilient fit, the plastic insert prevents the glass from undesirably sliding or banging back and forth in the railing, for example when the wind is gusting.

To install a balustrade, in some designs the balusters are anchored into the floor or along the external edge of the balcony floor. They may be anchored directly, or with the use of various fastening brackets. A bottom rail is secured to the vertical sides of the balusters, with the channel facing upward. A top rail may be secured in some cases to the vertical sides of the balusters as well, and in other cases may be installed on the tops of the balusters to span a number of balusters. Regardless of the design of the top railing, the channel will be facing downward. In some instances, the panel will be inserted prior to installation of the top rail. In other instances, and when subsequent to initial installation where service is required, the balusters and rails are already installed and then the panel must be inserted. When both rails are installed, the panel is generally centered between adjacent balusters and lowered so that the top of the panel is just below the bottom of the top rail.

In this position, the panel may be tilted slightly so that the top of the panel aligns with the top rail channel, and then raised so that the top of the panel slides into the top rail channel. As long as the top rail channel is sufficiently deep and the spacing between the top and bottom rails is appropriate, the panel will be raised sufficiently to bring the bottom edge of the panel above the top of the bottom rail. At this point, the bottom edge of the panel may next be pivoted to align with the bottom rail channel Finally, the panel is gently lowered into the bottom rail channel. When the top and bottom rails are spaced appropriately, the bottom edge of the panel will then rest in the bottom of the bottom rail channel, and the top edge of the panel will still be secured within the top rail channel. This arrangement of components and installation/service technique has been in use for years, with great success and reception.

Nevertheless, the present inventors have recognized several deficiencies in the present balustrade and panel construction. One deficiency is the ability for the panel to be slid by a resident, guest, or other person from an installation position centered between adjacent balusters to a position closer to a first one of the two adjacent balusters. This will undesirably increase the spacing between the panel and the second one of the two adjacent balusters, which will at least leave the spacing visually unpleasant. In some cases, the extra spacing between the panel and the second one of the two adjacent balusters may increase to an unsafe distance through which a small child may undesirably pass.

A second deficiency is the potential for a resident, guest, or other person to lift the panel and then tilt the lower edge of the panel sufficiently to remove the panel from the lower rail channel. If a person managed to lift and tilt the panel, the panel could then drop, potentially catastrophically, from the balustrade.

Yet another deficiency is the limited support provided by the channel in the top rail. While for some stronger and more resilient panels this may be of little consequence, in the case of more frangible panels any further distribution of force and support than that provided solely by the top rail is beneficial.

A few artisans have devised apparatus that overcomes at least some of these aforementioned deficiencies. Exemplary U.S. and Foreign patents and published applications, the teachings which are incorporated herein by reference, include: U.S. Pat. No. 3,385,567 by Case et al, entitled "Railing constructions and parts therefor or the like"; and CN201679173U by Ziqiang et al, entitled "Glass clamp for stair rail". Unfortunately, each of these require custom panels either having holes formed entirely through the panel at each end, or grooves in the panels adjacent to each end. These holes and grooves are difficult and expensive to form, particularly in the case of tempered glass.

Additional patents of varying relevance, the relevant teachings and contents which are incorporated herein by reference, include: U.S. Pat. No. 4,912,898 by Holmes, entitled "Glass butt joints for curtain wall construction"; and JP2011190631A by Hirose et al, entitled "Device for attaching balustrade glass".

In addition to the foregoing patents, Webster's New Universal Unabridged Dictionary, Second Edition copyright 1983, is incorporated herein by reference in entirety for the definitions of words and terms used herein.

As may be apparent, in spite of the enormous advancements and substantial research and development that has been conducted, there still remains a need for a glass panel securement that ameliorates the aforementioned deficiencies, in a manner that is easily and intuitively achieved by an installer for minimal cost.

SUMMARY OF THE INVENTION

In a first manifestation, the invention is in combination, a balustrade, a panel inserted into said balustrade, a selectively inserted panel securement securing said panel into said balustrade, and a fastener. The balustrade comprises: a bottom rail; a top rail extending longitudinally generally parallel to and spaced apart from the bottom rail; a channel longitudinally extensive along a lower surface of the top rail with a longitudinally extensive opening into an interior of the channel facing toward the bottom rail; at least one baluster extending longitudinally between the top and bottom rails; and a panel having a bottom edge supported by the bottom rail, having a top edge supported within the channel, and having a side edge longitudinally extending generally parallel to the at least one baluster. The selectively inserted panel securement comprises: a riser having a contact surface adjacent to the panel side edge and restricting movement of the panel in a first axial direction; and a panel retaining member inserted into the channel and having a contact surface adjacent to the panel top edge and restricting movement of the panel in a second axial direction different from the first axial direction. The fastener fastens the selectively inserted panel securement to the top rail within the channel In a second manifestation, the invention is a method of installing a balustrade. In accord with the method, balusters are supported. A bottom rail and a top rail having a channel longitudinally extensive along a lower surface of the top rail with a longitudinally extensive opening into an interior of the channel facing toward the bottom rail are each installed to the balusters. A panel is inserted between the balusters and the top and bottom rails and into the channel A panel retaining member is introduced at least partially into the channel. The panel retaining member is positioned within the channel, above a top edge of the panel within the channel A riser is placed adjacent to a side edge of the panel. Vertical motion of the panel is limited by fastening the positioned panel retaining member relative to the channel Horizontal motion of the panel is restricted by fastening the placed riser relative to the channel, thereby securing the panel.

OBJECTS OF THE INVENTION

Exemplary embodiments of the present invention solve inadequacies of the prior art by providing in combination a balustrade having top and bottom railings, a panel of glass or other suitable material, and a glass panel securement that secures the panel to the top and bottom railings and that prevents movement of the panel relative to the rails through at least one axis, and more preferably through three orthogonal axes.

The present invention and the preferred and alternative embodiments have been developed with a number of objectives in mind. While not all of these objectives are found in every embodiment, these objectives nevertheless provide a sense of the general intent and the many possible benefits that are available from embodiments of the present invention.

A first object of the invention is to secure panels at a location determined by an installer intermediate between the rails and balusters within a balustrade. A second object of the invention is to secure the panel using an apparatus that is very easy for the installer to install and very difficult to alter or change by someone other than an installer. Another object of the present invention is to provide a securement apparatus that does not require custom geometry or alteration to the panel for proper operation. A further object of the invention is to provide a glass panel securement that secures a panel to the top and bottom railings of a balustrade, and that prevents movement of the panel relative to the top and bottom railings through at least one axis, and more preferably through three orthogonal axes. Yet another object of the present invention is to provide a securement apparatus in accord with the aforementioned objects that is both easy to manufacture and self-contained within one apparatus or a pair of like apparatuses. An additional object of the present invention is to provide a glass panel securement in accord with the aforementioned objects that is not visible from an ordinary viewing angle. A further object of the present invention is to provide additional distribution of force and support beyond that provided solely by the top rail, particularly for more glass and other panels that may be relatively more frangible.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Figure 1:
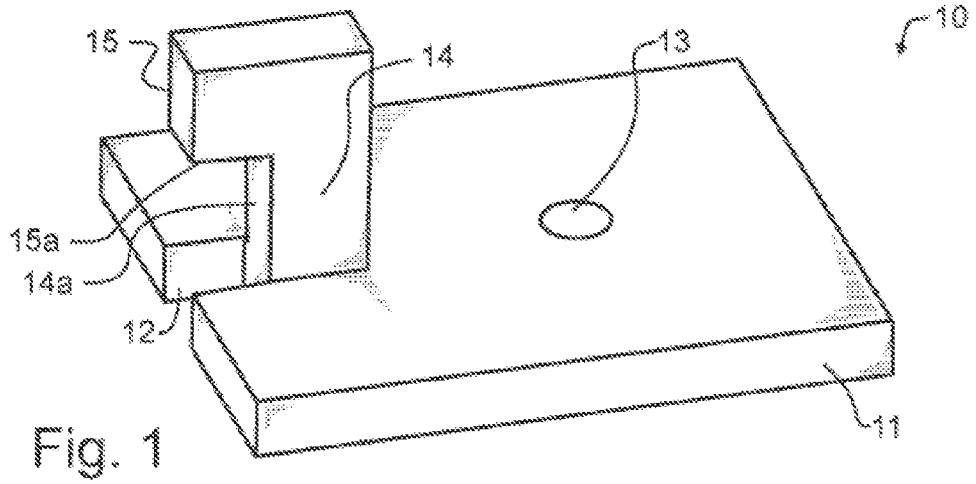
FIG. 1 illustrates a preferred embodiment glass panel securement designed in accord with the teachings of the present invention from a projected view.

In a preferred embodiment of the invention illustrated in FIG. 1, a panel securement 10 for glass railings has a base 11 that forms the primary support. A panel receiving notch 12 and fastener hole 13 are each preferably formed into base 11. Extending out of the plane of base 11 is a riser 14 that terminates at panel retaining member 15. Riser 14 and panel retaining member 15 are generally perpendicular to each other, and each form a leg that together define an "L"-shaped geometry.

The material used to manufacture preferred embodiment panel securement 10 is not critical to the invention, and so may be selected from a variety of materials, including metals, resins and plastics, ceramics or cementitious materials, or even combinations or composites of the above. The specific material used may vary, though special benefits are attainable if several important factors are taken into consideration. In consideration thereof, a durable plastic injection molded part is most preferred for several reasons. First and most apparent, the additional geometric features that define panel receiving notch 12, fastener hole 13, riser 14, and panel retaining member 15 may all be formed during the single molding operation, thereby keeping manufacturing costs low. Less apparent is the inherent resilience and soft contact surface offered by plastic, which is preferred for engagement with a panel, particularly a glass panel. Finally, the plastic will offer very good environmental resistance, similar in that regard to an aluminum rail or plastic channel insert. Consequently, a suitable material will, for a given fabrication dimension, offer sufficient strength and durability, and sufficient environmental resistance including both corrosion and cold-crack resistance.

Figure 2:
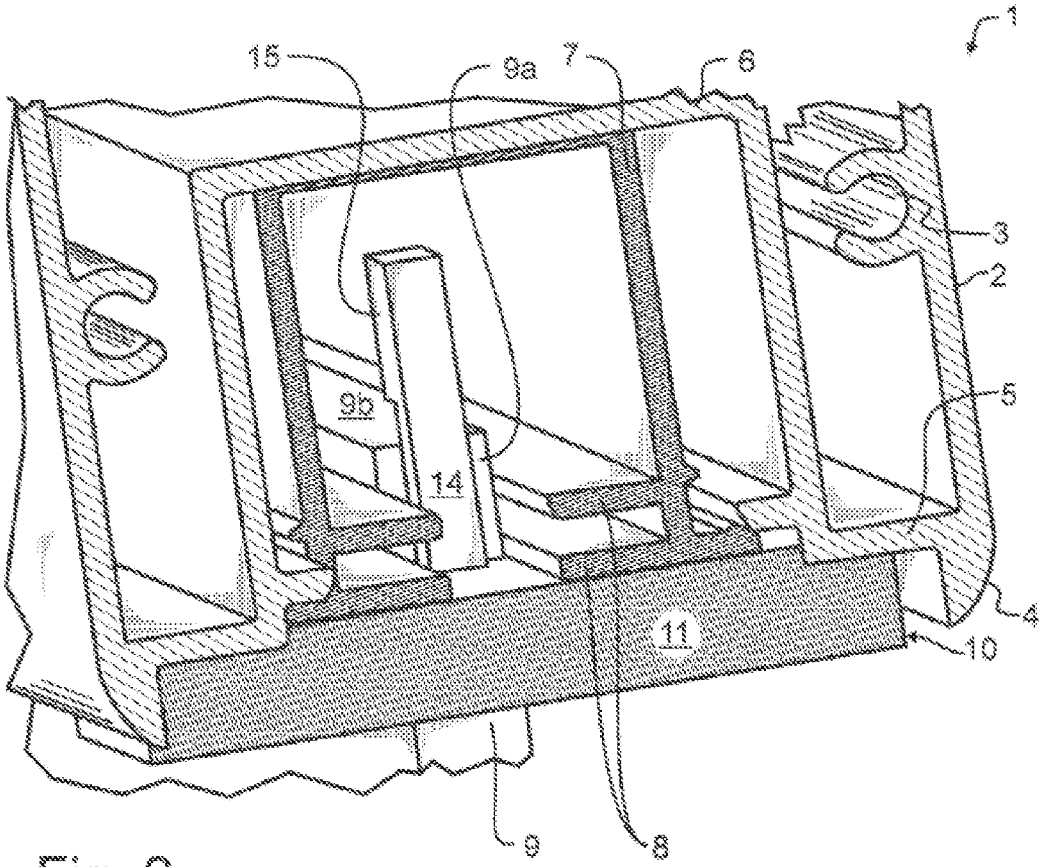
FIG. 2 illustrates the preferred embodiment balustrade including the preferred embodiment glass panel securement of FIG. 1 in further combination with a top rail and panel from an end and slightly projected view, with the baluster removed for purposes of illustration.
Figure 3:
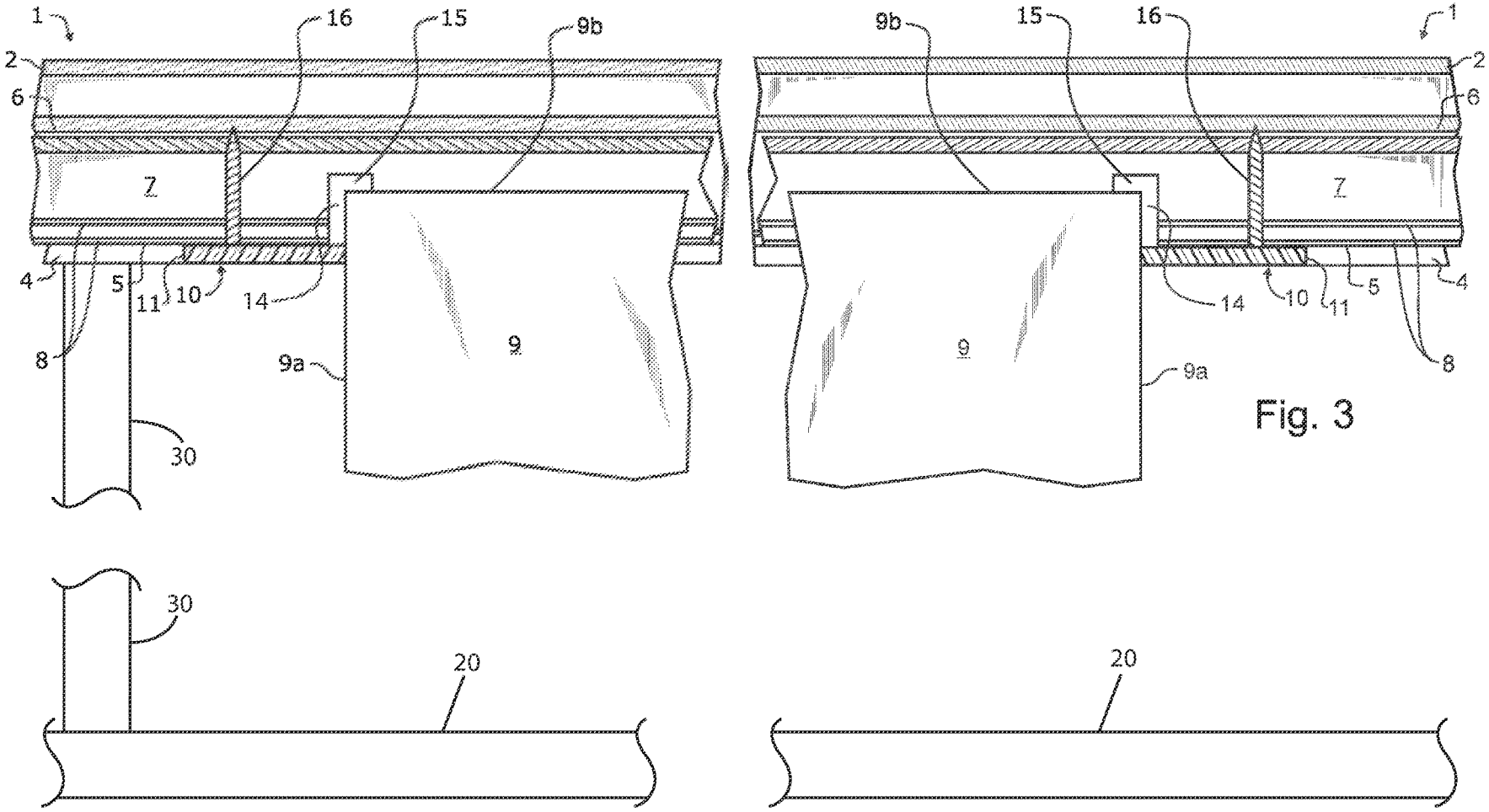
FIG. 3 illustrates the preferred embodiment balustrade of FIG. 2 from sectional view taken along a vertical plane parallel and adjacent to the surface of the panel.

FIGS. 2 and 3 illustrate the preferred embodiment balustrade 1 including the preferred embodiment panel securement 10 in further combination with a top rail 2 and panel 9, and with the baluster 30 and bottom rail 20 removed from FIG. 2 for purposes of illustration. Top rail 2 may, for exemplary and non-limiting purpose, include a longitudinally extensive screw channel 3 that will simultaneously provide nominal reinforcing or stiffening, and will also provide a substantially cylindrical region that a self-tapping or machine screw passing through or affixed with the baluster 30 may be driven into and engage with.

A bottom lip 4 and recessed lower surface 5 provide a containment area within which base 11 will preferably fit. The precise thickness of base 11 and recess depth of recessed lower surface 5 are preferably similar, but there is no requirement that they be identical. Nevertheless, if they are close or if recessed lower surface 5 is deeper than the thickness of base 11, then preferred embodiment panel securement 10 will be substantially out of sight from a mischievous resident, guest, or other person acting in the heat of the moment.

An exemplary interior U-shaped channel 6 receives extruded plastic channel insert 7. Channel insert 7 has two pairs of opposed panel retention fingers 8 that are preferably sufficiently resilient to accommodate diverse thicknesses of panels and gently squeeze against a panel 9 inserted therein.

The installation of a preferred embodiment balustrade 1 such as illustrated in FIGS. 2 and 3 includes the prior art steps outlined herein above, which include the anchoring of balusters installation of the top rail 2, bottom rail 20, and insertion of panel 9 by tilting the top edge of panel 9 into alignment with top plastic channel insert 7, lifting panel 9, aligning the bottom edge of panel 9 with the bottom rail, 20, and then lowering the bottom edge of panel 9 until panel 9 rests in the bottom rail 20. As illustrated in FIGS. 2 and 3, if the spacing is appropriate the top edge of panel 9 will still be located and held within plastic channel insert 7, held there preferably between panel retention fingers 8.

Continuing the installation in accord with the teachings of the present invention, preferred embodiment panel securement 10 is slipped into top rail 2. This includes inserting riser 14 and panel retaining member 15 into an unoccupied portion of the gap between opposed panel retention fingers 8. Since panel 9 will fully also occupy a portion of this gap between opposed panel retention fingers 8, riser 14 and panel retaining member 15 will insert adjacent to panel 9, until base 11 engages with recessed lower surface 5, preferably fully contained within bottom lip 4 and so not visible except when looking from underneath top rail 2.

Next, preferred embodiment panel securement 10 will be slid along recessed lower surface 5 in a direction toward panel 9. From FIG. 3, this motion would be from starting at the right side of the Figure and sliding to the left. Continuing this sliding motion, panel retaining member 15 will pass over the top edge of panel 9, and horizontal panel retaining surface 15*a* will slide on top of horizontal panel edge 9*b*. With additional sliding, vertical panel edge 9*a* will become encompassed by panel receiving notch 12. Preferably, and though not strictly essential, a final sliding motion in the same direction will engage vertical riser surface 14*a* with vertical panel edge 9*a*, which is the position illustrated in FIG. 3.

A fastener 16, which may for exemplary and non-limiting purpose comprise a sheet metal or other self-tapping screw, will be driven into place through fastener hole 13, preferably entirely through plastic channel insert 7 and into interior U-shaped channel 6, as best illustrated in FIG. 3.

For those installations requiring the utmost of security, fastener 16 may comprise a special head such as an anti-tampering head requiring a unique driver or tool, preventing tampering with ordinary tools. While a screw is described, any type of fastener known in the mechanical arts and capable of holding preferred embodiment panel securement 10 in place within bottom lip 4 of top rail 2 will be understood to be incorporated herein, including but not limited to adhesives, bolts, clips, and so forth.

As illustrated, the geometries of vertical riser surface 14*a* and horizontal panel retaining surface 15*a* are each planar and rectangular. With a relatively strong and rigid plastic or metal material used for preferred embodiment panel securement 10, this geometry is preferable owing to even distribution of force across the entire large area of surfaces 14*a*, 15*a* into panel 9. This even distribution of force is beneficial and can even be critical in the case of a glass panel, since any concentration of force on a small area of either vertical panel edge 9*a* or horizontal panel edge 9*b* can lead to chipping and even potential failure of the entire panel 9. Nevertheless, the geometry may be varied to suit a particular need or interest, and may further be combined with materials selection to yield a preferred securing bracket for one or more specific applications. Where the material of preferred embodiment panel securement 10 is softer, more resilient, or both, different geometries may be used that incorporate a gradual building of force between panel 9 and surfaces 14*a*, 15*a*. For exemplary and non-limiting purpose, with a more resilient material surfaces 14*a*, 15*a* may be textured or otherwise shaped such that the more elevated portions of the surface area will contact panel edges 9*a*, 9*b* first and compress slightly, leading to greater and greater contact area. As long as the material used for preferred embodiment panel securement 10 is sufficiently soft, resilient, or both to yield at a force below the fracture point of panel 9, such geometries and materials can provide additional beneficial dampening of movement and vibration. Therefore, in some alternative embodiments surfaces 14*a*, 15*a* will be non-linear, non-planar, non-rectangular, or of reduced area. Nevertheless, for most applications and as already described herein above, most plastic compositions will provide adequate dampening without the need for further modification of the surface geometry from that illustrated.

While horizontal panel retaining surface 15*a* is illustrated and described as being in intimate contact with horizontal panel edge 9*b* at the time of installation, this is not required and in fact will likely not occur in many of the installations. As is known in the building trades, dimensional tolerances are generally relatively large. This means that panel 9 may vary measurably in both height and width from the nominal dimensions that a builder or installer specified. A variable width of panel 9 is readily accommodated by the preferred installation method outlined herein, owing to the horizontal sliding of preferred embodiment panel securement 10 along recessed lower surface 5 at the time of installation. However, the height of horizontal panel retaining surface 15*a* relative to horizontal panel edge 9*b* is not readily adjusted. Consequently, at the time of design, the vertical rise provided by riser 14 must be great enough to accommodate the anticipated range of vertical dimensions for each panel 9 and the variability of distance between top rail 2 and the bottom rail 20, while still providing the needed securement to prevent panel 9 from being removed vertical from the bottom rail 20. In consideration thereof, there will most commonly be a distinct gap between horizontal panel retaining surface 15*a* and horizontal panel edge 9*b*.

When installed as described herein above, preferred embodiment panel securement 10 will prevent a person from lifting panel 9. Likewise, optional panel receiving notch 12 will help to better secure panel 9 against motion transverse to top rail 2 than normally provided by panel retention fingers 8. Finally, the end of panel receiving notch 12 defined by the presence of base 11 will prevent panel 9 from being slid in a direction parallel to the longitudinal axis of top rail 2. As may be apparent, the presence of base 11 will only prevent movement in one direction parallel to the longitudinal axis of top rail 2, toward base 11. In some installations, the panel may be located on one side edge adjacent to a baluster or wall. In such instances, a single preferred embodiment panel securement 10 will be sufficient to prevent movement along this top rail longitudinal axis. However, in most installations, panel 9 will be centered between adjacent balusters. In that case, the provision of two preferred embodiment panel securements 10, one at each distal side edge of panel 9, will be required to prevent movement in either direction parallel to the top rail longitudinal axis.

With two preferred embodiment panel securements 10 properly installed, panel 9 will be secured in three orthogonal axes. Absent premeditation, and in those situations where a special fastener 16 is used, absent a special tool, a resident, guest, or other person will not be able to inadvertently displace or release panel 9 from balustrade 1. Nevertheless, a balustrade requiring service may be disassembled very easily, starting with removal of fastener 16 to enable preferred embodiment panel securement 10 to be removed.

Figure 4:
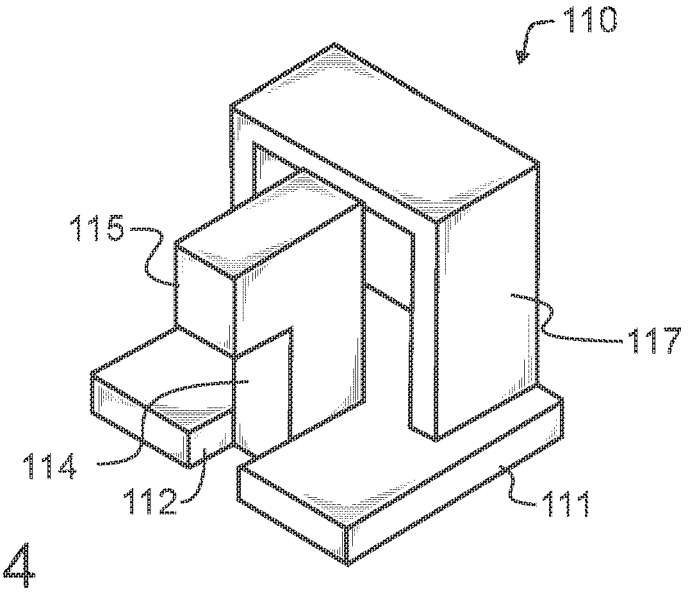
FIG. 4 illustrates a first alternative embodiment glass panel securement designed in accord with the teachings of the present invention and which is configured for a different type of glass railing that is a mid-rail horizontal support that holds the top of the glass and is located several inches below the top rail, from a projected view.

A first alternative embodiment panel securement 110 is illustrated in FIG. 4. The embodiments are distinguished by the hundreds digit, and various components within each embodiment designated by the ones and tens digits. However, many of the components are alike or similar between embodiments, so numbering of the ones and tens digits have been maintained wherever possible, such that identical, like or similar functions may more readily be identified between the embodiments. If not otherwise expressed, those skilled in the art will readily recognize the similarities and understand that in many cases like numbered ones and tens digit components may be substituted from one embodiment to another in accord with the present teachings, except where such substitution would otherwise destroy operation of the embodiment. Consequently, those skilled in the art will readily determine the function and operation of many of the components illustrated herein without unnecessary additional description.

First alternative embodiment panel securement 110 has a base 111, but lacks the fastener hole 13 found in preferred embodiment panel securement 10. Instead of fastener hole 13, a U-shaped fastener anchor 117 is provided. In some instances, the top rail may not be provided with an interior U-shaped channel 6 that is spaced from the very top of top rail 2. In such case, the successful insertion of a fastener vertically as illustrated in FIG. 3 could be difficult and dangerous, with risk of piercing entirely through the top rail. In other cases, a horizontally oriented fastener may simply be preferred. In yet other instances, a secondary rail is provided below the top rail, and this secondary rail may not be configured to work suitable with preferred embodiment panel securement 10. In any of these instances, and others that will be recognized by those reasonably skilled in the art in light of the present disclosure, a fastener such as fastener 16 may be driven through the side of top rail 2 into the relatively large vertical face provided by U-shaped fastener anchor 117 to secure alternative embodiment panel securement 110 in place.

While the vertical orientation of fastener 16 passing through fastener hole 13 helps to draw preferred embodiment panel securement 10 up into abutting relationship against recessed lower surface 5, which in most applications is also substantially hidden from view of a person, this also necessarily restricts vertical adjustment of panel securement 10 at the time of installation into top rail 2. In contrast, in alternative embodiment panel securement 110, an installer may adjust panel securement 110 up or down somewhat, to better accommodate the dimensional variations in panel 9 and spacing variations between top rail 2 and the bottom rail 20.

In some alternative embodiments, the inclusion of panel receiving notches 12, 112 may be undesirably limiting. In such alternative embodiments, panel receiving notches 12, 112 may be removed, and as a result, panel 9 will be secured against movement along two orthogonal axes rather than three and panel retention fingers 8 will be relied upon for securement along the third orthogonal axis.

While preferred embodiment panel securements 10, 110 are illustrated with the other features of a preferred embodiment balustrade 1, having particular utility with glass panels, it will be understood by those skilled in the art of railings and balustrades that the present invention is applicable with many different geometries of railings with much efficacy and benefit. Furthermore, while the present description and Figures illustrate and describe top rail 2 as extending longitudinally horizontally, vertical riser surface 14*a* extending in a vertical plane, and horizontal panel retaining surface 15*a* extending in a horizontal plane, it will be understood that these orientations may be altered to accommodate some applications. For exemplary and non-limiting purpose, a stairway balustrade is inclined, meaning the top rail will also commonly be inclined. In such instances, the references to horizontal and vertical will be defined and understood herein to be offset in accord with the altered inclination of the balustrade.

While the foregoing details what is felt to be the preferred embodiment of the invention, no material limitations to the scope of the claimed invention are intended. Further, features and design alternatives that would be obvious to one of ordinary skill in the art are considered to be incorporated herein. The scope of the invention is set forth and particularly described in the claims herein below.

We claim:

1. In combination, a balustrade, a panel inserted into said balustrade, a selectively inserted panel securement securing said panel into said balustrade, and a fastener, said balustrade comprising:

a bottom rail;

a top rail extending longitudinally generally parallel to and spaced apart from said bottom rail;

a channel longitudinally extensive along a lower surface of said top rail with a longitudinally extensive opening into an interior of said channel facing toward said bottom rail;

at least one baluster extending longitudinally between said top and bottom rails; and said panel having a bottom edge supported by said bottom rail, having a top edge supported within said channel, and having a side edge longitudinally extending generally parallel to and facing said at least one baluster;

said selectively inserted panel securement comprising:

a riser having a contact surface adjacent to said panel side edge and restricting movement of said panel in a first axial direction;

a panel retaining member inserted into said channel and having a contact surface adjacent to said panel top edge and restricting movement of said panel in a second axial direction from said first axial direction;

a U-shaped fastener anchor; and said fastener passing through a side of said top rail and into said U-shaped fastener anchor to affix selectively inserted panel securement to said top rail, fasting said selectively inserted panel securement within said channel.

2. The combination balustrade, panel, and selectively inserted panel securement of claim 1, wherein said selectively inserted panel securement further comprises a base, said riser coupled on a first end to said base and on a second end distal to said first end to said panel retaining member.

3. The combination balustrade, panel, and selectively inserted panel securement of claim 2, wherein said top rail further comprises a pair of bottom lips defining a recessed lower surface against which said base is secured.

4. The combination balustrade, panel and selectively inserted panel securement of claim 2, wherein said riser has a contact surface extending longitudinally in a direction generally parallel to said longitudinal extension of said at least one baluster, and wherein said panel retaining member has a contact surface extending longitudinally in a direction generally perpendicular to said longitudinal extension of said at least one baluster.

5. The combination balustrade, panel, and selectively inserted panel securement of claim 2, wherein said base further comprises a panel receiving notch encompassing said panel on three faces, said panel receiving notch configured to secure said panel against motion transverse to said top rail.

6. The combination balustrade, panel, and selectively inserted panel securement of claim 5, wherein said at least one baluster further comprises two adjacent and spaced-apart balusters, said panel centered between said two adjacent balusters, and further comprising a second selectively inserted panel securement at a side edge of said panel distal to said selectively inserted panel securement, said second selectively inserted panel securement configured in combination with said selectively inserted panel securement to prevent movement in either direction parallel to said top rail longitudinal axis.

7. The combination balustrade, panel, and selectively inserted panel securement of claim 1, wherein said panel further comprises a glass panel.

8. The combination balustrade, panel, and selectively inserted panel securement of claim 2, wherein said U-shaped fastener anchor is coupled at each distal end to said base.

9. The combination balustrade, panel, and selectively inserted panel securement of claim 8, wherein said fastener extends longitudinally perpendicular to a plane defined by said panel.

10. The combination balustrade, panel, and selectively inserted panel securement of claim 1, wherein said fastener fastens said selectively inserted panel securement to a fixed position within said channel or wherein said fastener further comprises a tamper-proof fastener head.

11. The combination balustrade, panel, and selectively inserted panel securement of claim 1, wherein said fastener extends longitudinally in a direction generally perpendicular to said channel longitudinal axis or wherein said fastener extends longitudinally within a plane defined by said panel.

12. The combination balustrade, panel, and selectively inserted panel securement of claim 1, wherein the contact surface contacts said panel side edge or wherein the first axial direction is parallel to a longitudinal axis of the top rail.

13. A method of installing a balustrade, comprising the steps of:

supporting balusters;

installing to said balusters a bottom rail and a top rail having a channel longitudinally extensive along a lower surface of said top rail with a longitudinally extensive opening into an interior of said channel facing toward said bottom rail;

inserting a panel between said balusters and bottom rails and into said channel;

introducing a panel retaining member at least partially into said channel;

positioning said panel retaining member within said channel above a top edge of said panel within said channel;

placing a riser adjacent to a side edge of said panel, the side edge facing said baluster;

limiting vertical motion of said panel by fastening, by a fastener passing through a side of said top rail and into a U-shaped fastener to affix said positioned panel retaining member to said top rail, said positioned panel retaining member relative to said channel; and restricting horizontal motion of said panel by fastening, by said fastener passing through said side of said top rail and into said U-shaped fastener anchor to affix said placed riser to said top rail, top said placed riser relative to said channel, thereby securing said panel.

14. The method of installing a balustrade of claim 13, furthering comprising the step of rigidly affixing said panel retaining member to said riser to define a single "L" shaped selectively inserted panel securement prior to said step of introducing.

15. The method of installing a balustrade of claim 14, further comprising the step of bonding a base to said selectively inserted panel securement prior to said stop of introducing, wherein said step of introducing further comprises moving said selectively inserted panel securement into said channel until said base engages with a recessed lower surface of said top rail.

16. The method of installing a balustrade of claim 15, wherein, subsequent to said step of introducing, said steps of positioning and placing further comprise the step of sliding said selectively inserted panel securement along said recessed lower surface of said top rail while said panel retaining member passes above the top edge of said panel until said selectively inserted panel securement firmly engages with said panel.

17. The method of installing a balustrade of claim 16, further comprising the step of providing a notch in said base; and wherein said step of sliding further comprises sliding said selectively inserted panel securement along said recessed lower surface of said top rail until said panel is received within and encompassed on three faces by said notch.

18. The method of installing a balustrade of claim 14, wherein said step of restricting horizontal motion further comprises rigidly anchoring said placed riser relative to said channel.

19. The method of installing a balustrade of claim 18, wherein said step of restricting horizontal motion further comprises driving said fastener through said top rail in a direction transverse to a longitudinal axis of said top rail.

20. The method of installing a balustrade of claim 13, wherein the riser contacts said panel side edge or wherein the horizontal motion is parallel to a longitudinal axis of the top rail.

* * * * *